United States Patent [19]

Haws

[11] Patent Number: 4,798,224

[45] Date of Patent: Jan. 17, 1989

[54] AUTOMATIC HOT WATER RECOVERY APPARATUS

[75] Inventor: Spencer K. Haws, Mesa, Wash.

[73] Assignee: Alternative Energy Resources, Inc., Mesa, Wash.

[21] Appl. No.: 150,072

[22] Filed: Jan. 29, 1988

[51] Int. Cl.[4] ..... F16K 49/00

[52] U.S. Cl. ..... 137/337; 137/341; 137/558; 137/592; 126/362

[58] Field of Search ..... 126/362; 137/496, 334, 137/337, 590, 592, 341, 558

[56] References Cited

U.S. PATENT DOCUMENTS 3,851,661 12/1974 Fernandez ..... 137/558

4,160,461 7/1979 Vataru et al. ..... 137/337

4,321,943 3/1982 Haws ..... 137/337

4,518,007 5/1985 Haws ..... 137/337

4,697,614 10/1987 Powers et al. ..... 137/337

*Primary Examiner*—A. Michael Chambers

*Attorney, Agent, or Firm*—Walter A. Hackler

[57] ABSTRACT

Automatic hot water recovery apparatus is provided for conserving the energy in a pressurized plumbing system and water heater apparatus by recovering hot water from hot water lines extending to plumbing fixtures remotely disposed from the water heater. A piston is provided within the water heater to enable the displacement of water therein and to act as an indicator of system operation.

16 Claims, 1 Drawing Sheet

AUTOMATIC HOT WATER RECOVERY APPARATUS

The present invention is generally directed to automatic hot water recovery apparatus for the conservation of thermal energy, and is more particularly directed to a pressurized plumbing system and water heater apparatus for substantially reducing the thermal losses from unused hot water remaining in hot water lines.

It is well known that a considerable amount of thermal energy is wastefully dissipated from the hot water lines which provide intermittent hot water to plumbing fixtures, such as domestic wash basins, dishwashers and clothes washers.

The earliest attempt to reduce this thermal loss included the insulating of hot water heaters and hot water lines, which feed the plumbing fixtures. While the insulating of hot water lines slows the dissipation of heat, over an extended period of time no savings occurs if the intermittent use of hot water through the line still allows the hot water line to cool to ambient temperature.

Devices have been devised to actually recover the hot water remaining in hot water lines after the use of a fixture by drawing the hot water back into the hot water tank. Because the hot water is removed from the lines, there is an actual reduction in the amount of heat loss rather than just a slowing of the heat loss as occurs through the use of insulation alone.

An example of this type of system was disclosed in U.S. Pat. No. 4,321,943, which utilizes a pressure reducer in combination with the hot water heater and a bridge coupling, or conduit, interconnected between the hot and cold water lines of a hot water system proximate each of the fixtures therein. In operation, the pressure reducer lowers the pressure in the water heater tank and water pipe when cold water outlet is opened, in order to produce a flow of cold water from the cold water pipe into the hot water pipe thus forcing the hot water in the lines back into the hot water tank. This system relies on the creation of an air pocket in the heater tank, working as a pneumatic spring to return the hot water. In operation, the cold water backflow, forcing hot water back into the tank, continues until the pressure in the tank rises to equal the pressure in the cold water line.

Although workable, this system has a number of disadvantages, particularly in view of the fact that the system is intended for use in domestic installations and expected to function for periods of ten, or more years, without service or maintenance.

Because the system relies on an air pocket being developed within the tank, it is faced with the inherent problem of the air being dissolved in the water. When this occurs, there is not sufficient room in the tank in order to draw all of the hot water back into the tank during the backflow cycle of the system. This represents a gradual degradation in the effectiveness of the system and as the air pocket in the tank diminishes to zero, so does the effectiveness of the system.

Another disadvantage of the system in domestic use is the overall effectiveness of the system over a long period of time. It must be appreciated that once installed, the average homeowner is not motivated to provide any maintenance therefor, unless he or she has an indication of malfunction.

It is apparent from the system disclosed in U.S. Pat. No 4,321,943, that there is no easy way that a homeowner could determine, after an indeterminate period of time, whether the system is operating efficiently. Energy savings from such a system is important over long periods of time; that is, the energy saved during each recycle of water back into the water heater is rather small, but the accumulative effect over many, many years provides the incentive for installing such a system. Thus, it is imperative that not only must the system be reliable, it must be conveniently and easily checked as to its operability over periods of time measured in years.

This lack of long term effectiveness was recognized in U.S. Pat. No. 4,518,007, in which there is disclosed a heat recovery system utilizing a separate discreet insulated tank for use in conjunction with a water heater. The advantage of this later system resides in the fact that it eliminated a disassembly of the water heater tank and the installation of extra pipes for installation of the system.

As can be seen from the subject patent, the apparatus disclosed is quite complicated, using a piston with convoluted faces to effect a differential in pressure thereacross and an internal volume of air trapped inside to act as an airspring. As in the prior system, this later developed separate heat recovery tank relies on an internal trapped air pocket which must be sealed from hot water for periods of many years. It also has the disadvantage of being unserviceable by the homeowner, who also has no way of determining whether the piston disposed therein is operating in a normal function and that the automatic hot water recovery system is providing the energy conservation it was designed initially to produce.

The present invention, however, constitutes an automatic hot water recovery system which is not only simple in operation, but its operation is easily monitored without the use of special instruments or tools, or special instructions. Because of this, the present system is mos suitable for installation in domestic applications where little or no maintenance will be provided thereto for the life of the water heater, without an obvious display of its operability to a homeowner.

SUMMARY OF THE INVENTION

Water heater apparatus, in accordance with the present invention, which is suitable for use with a pressurized plumbing system having separate hot and cold water lines and conduit means, interconnected between the hot and cold water lines, for enabling cold water to pass from the cold water line into the hot water line, includes tank means for containing a volume of water under pressure greater than atmospheric pressure having an outlet configured for coupling to the hot water line. Heating means are provided for heating water contained in the tank means and water inlet means are provided having fitting means for coupling to a cold water supply line and a cold water line. The water inlet means is operational for introducing water to and withdrawing water from the tank means and includes piston means for displacing water within the tank means to both enable hot water, heated in the tank means,.to flow into the hot water line from the tank means and hot water, from the hot water line, to return into the tank means. In addition, the water inlet means further includes means for exerting atmospheric pressure on a portion of the piston means. As will be described hereinafter in greater detail, this eliminates the need for an internal air pocket as required by prior art devices. Because one side of the piston is subjected partially to atmospheric pressure, while an opposite side of the piston is subjected to the total pressure in the system when water is not being withdrawn therefrom, the piston acts to displace water within the tank and return hot water from the hot water lines into the tank means.

Importantly, in accordance with the present invention, indicator means are included for providing an indication of the piston means displacement operation in a manner which is visible from the outside of the tank means. In this manner, operation of the system can easily be checked by the observation of the indicator means without the use of special tools or instructions.

More particularly, the inlet means includes cylinder means disposed within the tank means for both guiding the piston means and enabling movement of the piston means to displace water within the tank means. In addition, the means for exerting atmospheric pressure on a portion of the piston means includes a rod attached to the piston means for movement therewith, with the rod extending outside of the tank means. Importantly, the portion of the rod extending outside of the tank means operates as the indicator means. In this manner, operation of the piston is easily noted from outside of the tank means by observation of the rod moving in and out of the tank.

More particularly, the present invention includes a seal disposed between a perimeter of the piston means and an inside wall of the cylinder means and the closed cylinder means includes group slot means disposed in one end of the cylinder means for both enabling flow of water out of the cylinder means to displace water in the tank means outside of the closed cylinder means and enabling water to flow out of one end of the closed cylinder means when the piston resides at the one end of the cylinder means.

The fitting means may be disposed in an opposite end of the closed cylinder means for enabling water disposed be&ween &he closed cylinder means opposite end and the piston means to flow into the cold water line when the piston means moves toward the closed cylinder means opposite end. This piston means movement toward the closed cylinder means opposite end causes displacement of water within the tank into the closed cylinder means through the slots means.

In terms of a pressurized plumbing system, the present invention includes tank means for containing a volume of water under pressure greater than atmospheric pressure and heating means for heating the water contained in the tank means. The hot water line is provided which is coupled to the tank means and extends to at least one plumbing fixture.

Water inlet means having fitting means for coupling to a cold water supply line and a cold water line are provided for introducing water to and withdrawing water from the tank means. The water inlet means includes piston means for displacing water within the tank means to both enable hot water, heated in the tank means, to flow into the hot water line from the tank means and hot water, from the hot water line, to return into the tank means. More particularly, the water inlet means further includes means for exerting atmospheric pressure on a portion of the piston means. Also provided is a cold water line coupled to the tank means and extending to the plumbing fixture and conduit means, interconnected between the hot water and cold water lines, for enabling cold water to pass from the cold water line into the hot water line. The conduit means is distally disposed from the tank means.

BRIEF DESCRIPTION OF THE DRAWINGS

The advantages and features of the present invention will appear from the following description when considered in conjunction with the accompanying drawings, in which.

DETAILED DESCRIPTION OF THE INVENTION

Figure 1:
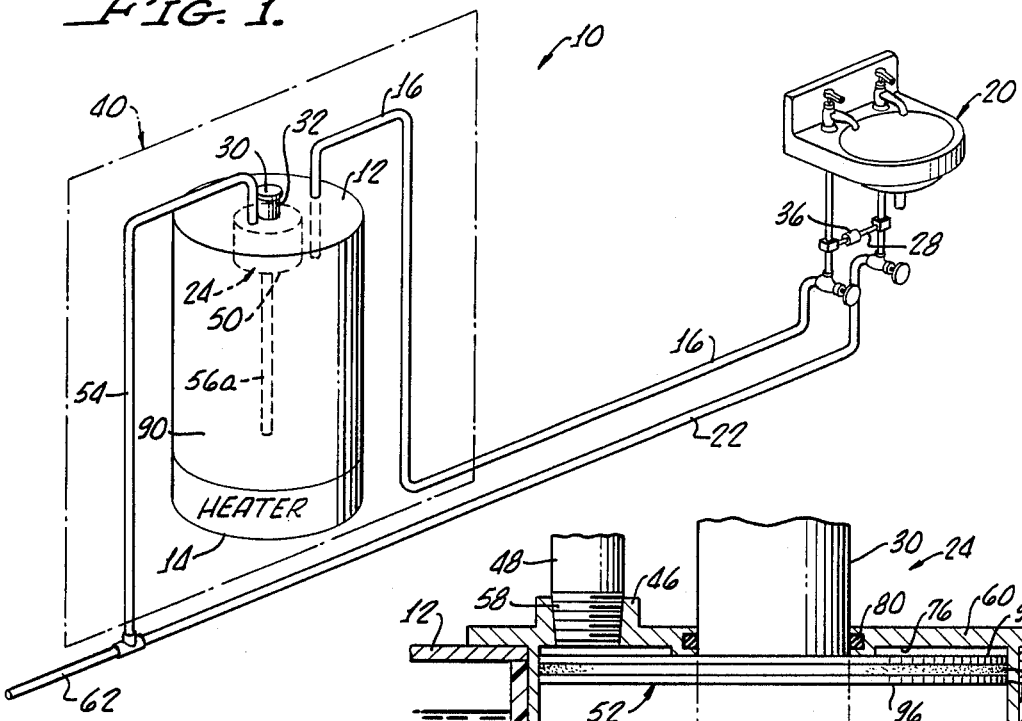
FIG. 1 is a diagrammatic drawing of the pressurized plumbing system and water heater apparatus in accordance with the present invention, generally showing the exterior of the tank hot and cold water lines with a conduit therebetween proximate a plumbing fixture. Importantly shown, is an indicator protruding from the top of the tank means by which continuous monitoring of the operability of the system can be visually maintained.

Turning to FIG. 1, there is a pressurized plumbing system 10, in accordance with the present invention, which generally includes a tank 12 having a heater 14, a hot water line 16 coupled to the tank 12 and extending to at least one plumbing fixture 20. A cold water line 22 coupled between the hot water tank inlet means 24 and the fixture 20 and a conduit 28 intercoupled between the hot water line 16 and the cold water line 22 proximate the plumbing fixture 20 provides means for enabling cold water to pass from the cold water line 22 into the hot water line 18, as will be hereinafter described in greater detail.

The pressurized plumbing system 10 diagrammed in FIG. 1 thus illustrates a portion of a domestic plumbing system, with the tank 12 providing means for containing a volume of water under pressure greater than atmospheric pressure and the heater 14 which may be gas or electric, providing means for heating the water contained in the tank 12.

An important feature of the present invention is the use in which the operation of the system may be monitored. As shown in FIG. 1, an end portion 30 of a movable rod 32 provides an indication of the system operation, as will be hereinafter described in greater detail.

The conduit 28 may have a smaller diameter than the hot and cold water lines 16, 22, or a flow restricter 36 may be provided to control the water flow between the cold water line 22 and the hot water line 16, as will be hereinafter described.

Figure 2:
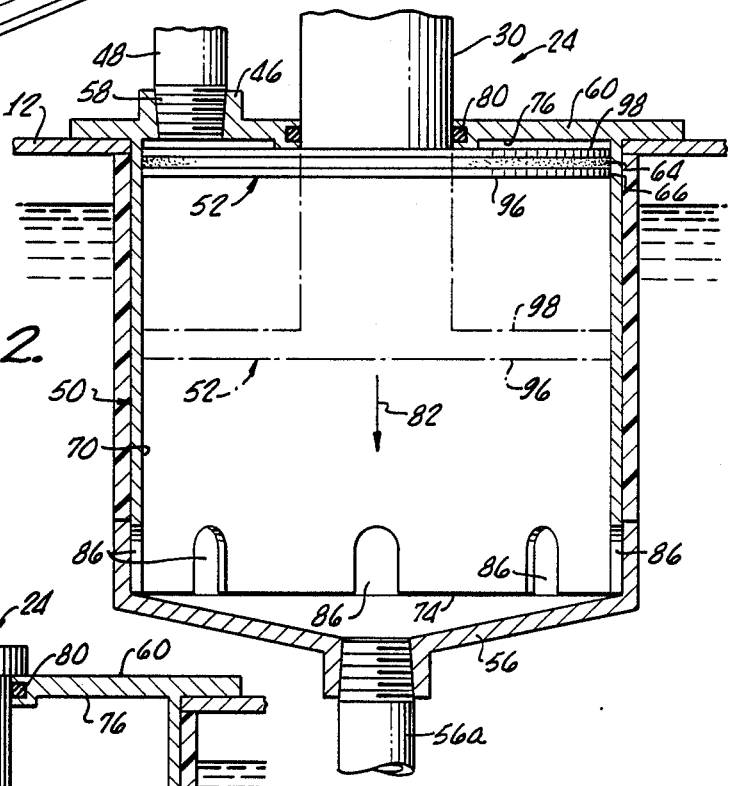
FIG. 2 is a cross-sectional view of an enlarged portion of the top of the tank showing greater detail. Inlet means in accordance with the present invention which includes a closed cylindrical cylinder within the tank means and a piston slidably disposed therein.
Figure 3:
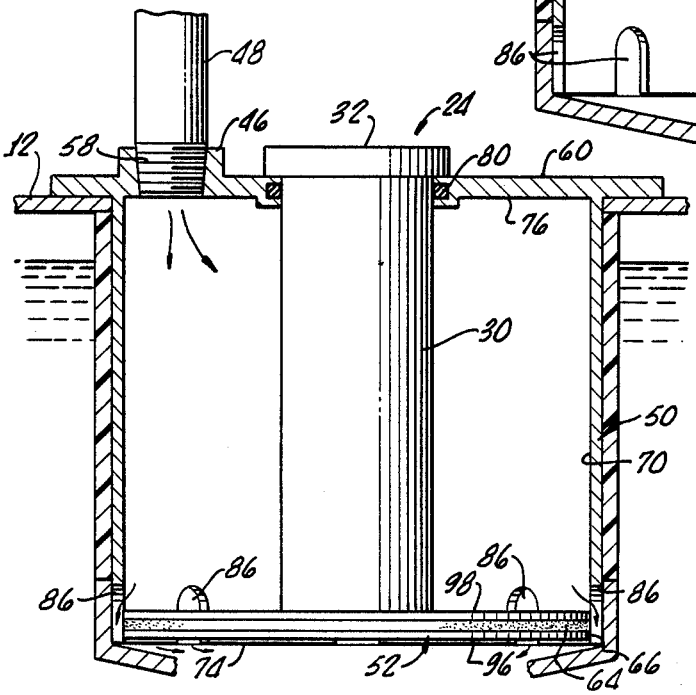
FIG. 3 is another cross-sectional view showing operation of the inlet means, in accordance with the present invention, with the piston disposed at one end of the cylindrical tube in a position where water entering from an inlet can pass thereby through slots into the remainder of the tank.

The water heater apparatus 40 which includes the tank 12, heater 14 and water inlet means 24, is shown in cross-sectional view in FIGS. 2 and 3, is shown in cross-sectional view in FIGS. 2 and 3, only the top portion of the tank being shown to more clearly illustrate the structure and function of the inlet means 24. The inlet means 24 generally includes a fitting 46, a cylinder 50, a piston 52, with the rod 30 attached thereto in any conventional manner. A line 54 interconnects the inlet means with the cold water line 22. An end cap 56 with a dip tube 56a is fitted to the cylinder 50 to enable the inlet means 24 to introduce water proximate the heater 14.

More particularly, the fitting 46 may include conventional plumbing threads 58 disposed in a top 60 of the cylinder 50 which provides means for coupling the water inlet means 24 to the water supply line 62 and the cold water line 22 through the line 54.

In order to introduce water to and withdraw water from the tank 12, the water inlet means 24 includes the piston 52 which is slidably mounted in the cylinder 50, with a piston seal 64 disposed between a perimeter 66 and an inside wall 70 of the cylinder 50. In operation, as will be hereinafter described, the piston 52 provides means for displacing water within the tank 12 which enables hot water, heated in the tank 12, to flow into the hot water line 16, and hot water, from hot water line 16, to return into the tank 12. During this operation, heat piston 52 moves from a position approximate one end 74 (FIG. 3) of the cylinder 50 to an opposite end 76 (FIG. 2) carrying along with it the rod 30 which also provides means for guiding the piston 52 within the cylinder by engagement therewith through a top seal 80. Since the end 32 of the rod 32 is visible from outside of the tank, the movement of the piston and the rod 30 is easily observed. Should the piston fail to move during operation of the system, malfunction is easily detected.

It should be appreciated that a cylinder piston and rod may be constructed of any suitable material that can withstand the temperature of typical domestic hot water heaters. Of course, for industrial applications, higher temperature materials may be required. Importantly, however, since there is no great pressure differential across the cylinder, a material able to withstand high pressures not required. The only portion of the tank subjected to pressure is the top 60.

It is important to recognize that the rod not only serves as an indicator of the system operation, but also provides means for exerting atmospheric pressure on a portion of the piston 52, which is fundamental to the operation of the water inlet means 24.

Initially, before use of the fixture 20, the piston 52 resides at the opposite end 76 of the cylinder 50 (FIG. 2). When the fixture 20 is utilized to draw hot water through the hot water line 16, a drop in pressure in the water tank 12 causes water to flow through the fitting 46 and between the piston and top 60, thereby forcing the piston 50 downward in the cylinder 50 as shown by the arrow 82 in FIG. 2. Slots 86, or the like, disposed in cylinder end 74 enable water flow therefrom into the body 90 of the tank via the dip tube 56a and thereafter into the hot water line 16. In this manner, the piston displaces water within the tank 12 to enable hot water, heated in the tank 12, to flow into the hot water line 16. This continues until the piston 52 reaches the end 74 of the cylinder 50 as shown in FIG. 3. In this position, the slots, or openings 86 are sized to enable continued water flow past the piston 52 and into the body of the tank 90.

It should be appreciated that the volume of the cylinder 50 is made to capacity, approximately equal to the anticipated volume of water to be returned from the hot water line 16. When hot water is no longer drawn from the hot water line 16, the pressure in the tank hot water line and cold water line 22 become equal and exert an upward force on the bottom 96 of the piston 52. As hereinbefore pointed out, the rod 50 exerts atmospheric pressure on a portion of a top 98 of the piston 52.

Water enters the hot water line through the conduit 28 from the cold water line 22 connected to the fitting 46 through line 54. The conduit 28 may be of a smaller diameter than the hot and cold water lines 16, 22, in order to limit mixing of cold water with hot water when hot water is withdrawn from the hot water line 16 via the fixture 20. Alternatively, a restriction 36 may be used to so limit the water flow.

Because the bottom 96 and top 98 of the piston 52 are of the same area and a portion of the piston 98 is subjected to atmospheric pressure, the total force on the bottom of the piston 96 is less than the force on the top of the piston 98, consequently, the piston will move toward the top 60 of the cylinder, drawing water through the slots 86 and displacing water within the tank which in turn causes the hot water in the hot water line 16 to return into the tank 12. Piston movement continues until it reaches the top of the cylinder 50, thus withdrawing all of the hot water from the hot water line if the volume of the cylinder 50 is equal to the volume of water in the hot water line 16. Importantly, there is no required air pocket within the tank or within the inlet means as is required by prior art devices. The only moving portion of the system is the piston 50 and rod 30 which can be selected to provide long term reliability.

It is to be appreciated that the seal 80 may be a typical O-ring seal, or it may include a diaphragm type seal, not shown, or any other suitable arrangement.

As hereinbefore noted, the rod end 32 provides an indication of the operation of the system. When water is withdrawn from the tank, the rod protruding from the tank 12 is substantially less than when the system has recovered all the hot water from the hot water line 16. In many instances, where the water heater is installed in a garage location, a casual look will reveal the operation of the system. On the other hand, if the tank 12 is disposed in a separate locker, or the like, operation can easily be determined by a brief examination of the tank.

Although there has been hereinabove described a particular arrangement of a pressurized plumbing system and water heater apparatus, in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the invention as defined in the appended claims.

I claim:

1. Water heater apparatus for use with a pressurized plumbing system having separate hot and cold water lines and conduit means, interconnected between the hot and cold water lines, for enabling cold water to pass from the cold water line into the hot water line, said water heater apparatus comprising:

tank means for containing a volume of water under pressure greater than atmospheric pressure, said tank means including an outlet configured for coupling to said hot water line;

heating means for heating water contained in said tank means; and, water inlet means, having fitting means for coupling to a cold water supply line and said cold water line, for introducing water to and withdrawing water from said tank means, said water inlet means including piston means for displacing water within said tank means to both enable hot water, heated in said tank means, to flow into the hot water line from the tank means and hot water, from the hot water line, to return into said tank means, said water inlet means further including means for exerting atmospheric pressure on a portion of the piston means.

2. The water heater apparatus according to claim 1 further comprising indicator means for providing an indication of the piston means displacement operation, said indicator being visible from outside of the tank means.

3. The water heater apparatus according to claim 2 wherein the inlet means further includes cylinder means, disposed within said tank means, for both guiding said piston means and enabling movement of the piston to displacing water within the tank means.

4. The water heater apparatus according to claim 3 wherein the means for exerting atmospheric pressure on a portion of the piston means comprises a rod attached to the piston means for movement therewith, said rod extending outside of the tank means.

5. The water heater apparatus according to claim 4 wherein said indicator means comprises a portion of the rod extending outside of the tank means.

6. The water heater apparatus according to claim 5 wherein the inlet means further includes a seal disposed between a perimeter of the piston means and an inside wall of the cylinder means and said closed cylinder means includes means disposed proximate one end of the cylinder means for both enabling flow of water out of said cylinder means to displace water in the tank means outside of said closed cylinder means and enabling water to flow out of the one end of said closed cylinder means when the piston resides at said one end.

7. The water heater apparatus according to claim 6 wherein the fitting means is disposed in an opposite end of said closed cylinder means for enabling water disposed within the closed cylinder means opposite end and the piston means to flow into the cold water line when the piston means moves toward the closed cylinder means opposite end, the piston means movement toward the closed cylinder means opposite end causing displacement of water within the tank means into the closed cylinder means through said slot means.

8. The water heater apparatus according to claim 7 wherein the closed cylinder means is heat insulated from water disposed in said tank means 9. A pressurized plumbing system comprising:

tank means for containing a volume of water under pressure greater than atmospheric pressure;

heating means for heating water contained in said tank means;

a hot water line coupled to said tank means and extending to at least one plumbing fixture;

water inlet means having fitting means for coupling to a cold water supply line and a cold water line for introducing water to and withdrawing water from said tank means, said water inlet means including piston means for displacing water within said tank means to both enable hot water, heated in said tank means, to flow into the hot water line from the tank means and hot water, from the hot water line, to return into said tank means, said water inlet means further including means for exerting atmospheric pressure on a portion of the piston means;

a cold water line coupled to said tank means and extending to said plumbing fixture; and conduit means, interconnected between the hot water and cold water lines, for enabling cold water to pass from the cold water line into the hot water line, said conduit means being distally disposed from said tank means.

10. The water heater apparatus according to claim 9 further comprising indicator means for providing an indication of the piston means displacement operation, said indicator being visible from outside of the tank means.

11. The water heater apparatus according to claim 10 wherein the inlet means further includes closed cylinder means disposed within said tank means, for both guiding said piston means and enabling movement of the piston to displacing water within the tank means.

12. The water heater apparatus according to claim 11 wherein the means of exerting atmospheric pressure on a portion of the piston means comprises a rod attached to the piston means for movement therewith, said rod extending outside of the tank means.

13. The water heater apparatus according to claim 12 wherein said indicator means comprises a portion of the rod extending outside of the tank means.

14. The water heater apparatus according to claim 13 wherein the inlet means further includes a seal disposed between a perimeter of the piston means and an inside wall of the cylinder means and said closed cylinder means includes slot means disposed in one end of the cylinder means for both enabling flow of water out of said cylinder means to displace water in the tank means outside of said closed cylinder means and enabling water to flow out of the one end of said closed cylinder means when the piston resides at said one end.

15. The water heater apparatus according to claim 14 wherein the fitting means is disposed in an opposite end of said closed cylinder means for enabling water disposed within the closed cylinder means opposite end and the piston means to flow into the cold water line when the piston means moves toward the closed cylinder means opposite end, the piston means movement toward the closed cylinder means opposite end carrying displacement of water within the tank means into the closed cylinder means through said slot means.

16. The water heater apparatus according to claim 15 wherein the closed cylinder means is heat insulated for water disposed in said tank means.

* * * * *